United States Patent [19]

Fischer et al.

[11] 4,357,742

[45] Nov. 9, 1982

[54] ELECTRIC BRUSH CONTACT FORMING APPARATUS

[75] Inventors: Charles P. Fischer; Andrew A. Peterson; Edward J. Doi, all of Sidney; Rodney W. Gossoo, Sidney Center; Jan C. Mitrzyk, Sr., Unadilla, all of N.Y.

[73] Assignee: The Bendix Corporation, Southfield, Mich.

[21] Appl. No.: 153,352

[22] Filed: May 27, 1980

[51] Int. Cl.[3] ..... H01R 43/00; H01R 43/12

[52] U.S. Cl. ..... 29/33 M; 29/33 J; 29/33 F; 29/564.6; 29/705; 29/710; 29/742; 29/796; 300/2

[58] Field of Search ..... 29/33 M, 33 K, 33 J, 29/33 F, 517, 564.1, 564.6, 705, 710, 742, 785, 792, 796, 826, 564.2; 300/1, 2, 9; 72/402; 339/49 R

[56] References Cited

U.S. PATENT DOCUMENTS 1,449,424 3/1923 Le Boeuf ..... 300/2 X
1,455,953 5/1923 Wright ..... 29/517
3,416,352 12/1968 Ribback ..... 72/402
3,725,844 4/1973 McKeown et al. ..... 339/49 R

FOREIGN PATENT DOCUMENTS 335104 12/1937 Italy ..... 29/826

*Primary Examiner*—Z. R. Bilinsky
*Attorney, Agent, or Firm*—William G. Kratz, Jr.; Raymond J. Eifler

[57] ABSTRACT

An apparatus for forming brush contacts from spools of wire and holders for angular ended wire segments cut from said wires, has a wire feeding means for feeding spools thereof independently of each other, a cutting device for cutting segments from the wires and feeding the segments to a common collection point where the segments are loaded into the holders provided, and a crimping device for crimping the holder to retain the wires therein without causing flaring of the exposed ends. A checking station is provided to determine whether each brush contact contains the requisite number of wire segments and ejection means to eject defective contacts. The completed contacts are collected in such a manner as to prevent damage thereto.

12 Claims, 22 Drawing Figures

ELECTRIC BRUSH CONTACT FORMING APPARATUS

The present apparatus is related to electrical connectors and is an apparatus for automatic formation of brush contacts, such that brush contacts may be formed continuously from spools of conductive wire and holders for cut wire segments.

In formation of wire contacts, wire segments must be cut which have angular ends, from spools of wire, and the cut segments fed to a holder therefor, with the angular ends exposed, the cup portions of the holder subsequently crimped to an extent that the wire segments will be retained therein, without flaring of the exposed ends relative to each other. In formation of a female contact, a sleeve must be secured over the cup portion of the holder to encircle the ends of the exposed wire segments.

The apparatus is usable, for example, in formation of wire contacts such as those described in U.S. Pat. No. 3,725,844, assigned to the assignee of the present invention, the contents of which are incorporated by reference, herein.

In order to continuously form such brush contacts, wire must be unreeled from rolls under tension to prevent tangling and without damage to the wires, while the replacement of empty reels must be convenient and quick. The wires must then be fed to a cutting mechanism that will cut wire segments, with angular ends, without forming burrs or rough edges, and these segments charged to a holder. The cup portion of the holder must be crimped in a manner that will retain the wires without causing flaring of the exposed ends of the wires. In the event that a holder does not contain the requisite number of wire segments, means must be provided to ascertain such a condition and remove the defective contact. Finished contacts must be collected in such a manner that the exposed ends thereof are not damaged.

SUMMARY OF THE INVENTION

The present apparatus comprises an apparatus for the continuous production of brush contacts having a plurality of wire segments, with acute angular ends, secured in a holder, which has means for independently feeding a plurality of wires from rolls, means for simultaneously cutting wire segments having acute angular ends from the plurality of wires, and feeding the cut segments to a common collection point, means for positioning a holder in a cradle to receive said cut segments such that the cup portion of the holder contains the segments, and means for crimping the holder to retain the plurality of wire segments without causing flaring of the exposed ends of the wire segments. A checking section is provided to determine and remove contacts having less than the required number of wire segments, and collection means are provided to collect and deposit finished contacts into containers therefore.

DETAILED DESCRIPTION

Figure 1:
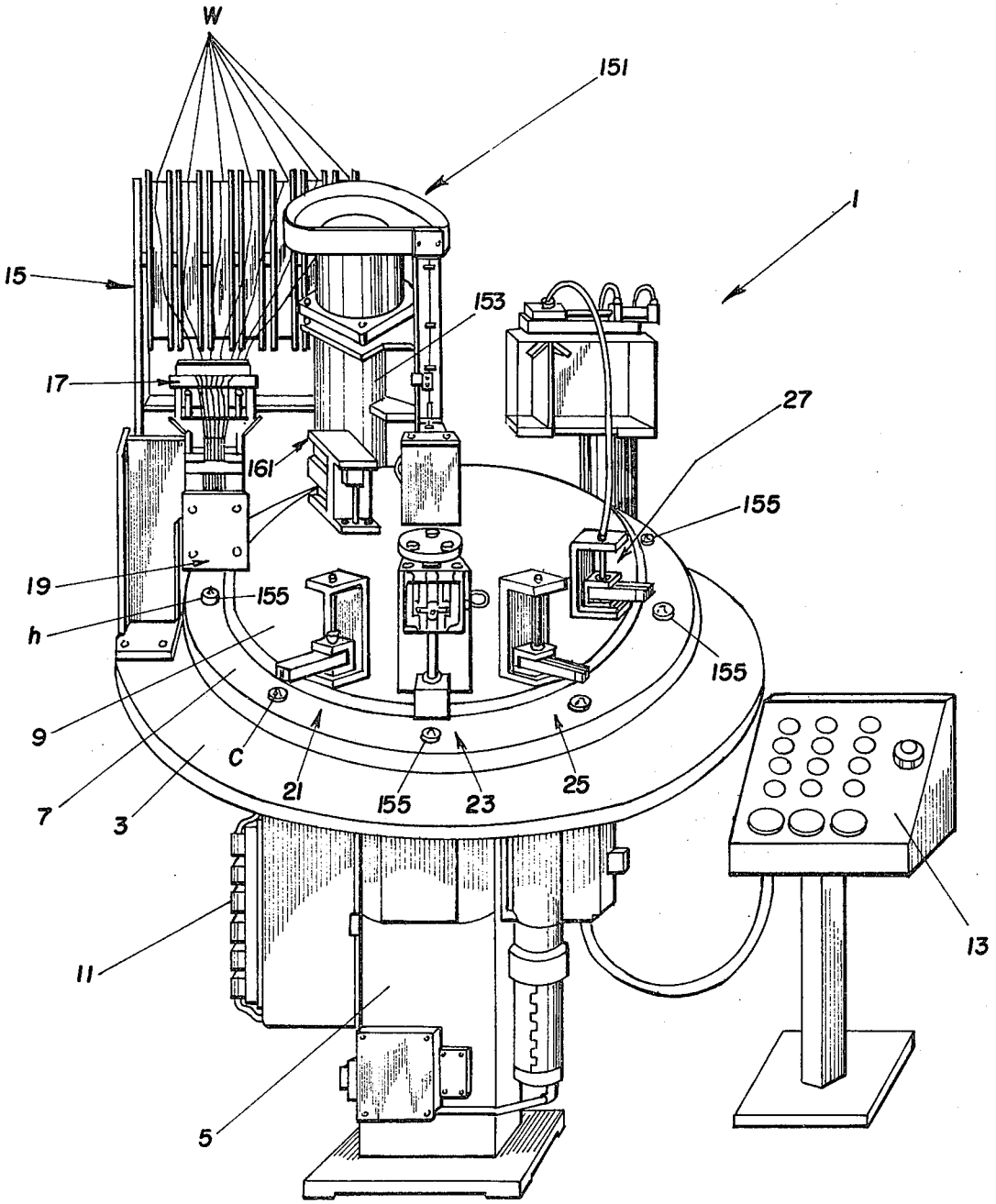
FIG. 1 is a schematic illustration of the apparatus of the present invention for automatically forming brush contacts.

As illustrated in FIG. 1, the present apparatus enables the automatic production of electrical brush contacts c from a plurality of rolls of wires w to a finished brush contact. The apparatus 1 comprises a support plate 3, supported on a base 5, an indexing plate 7 which is rotatable at a variable speed, and a reciprocating tool plate 9 upon which are positioned various tooling devices for the operations carried out during manufacture of the brush contacts c. Controls 11 and 13 are provided for actuation of the various tools on tool plate 9, as well as for actuation of the indexing plate 7, with means, preferably electrical and/or pneumatic, used to effect such actuation. Basically, the various stations that are provided in the apparatus for the automatic production of electrical brush contacts comprise a wire feeding station 15, wire cutting and segment feeding station 17, a holder loading station 19 at which individual segments s of wire are fed to a holder h, and a crimping station 21 for crimping of the holder to retain the wire segments s therein without flaring of exposed wire segment ends. Other stations include a checking station 23 for determining whether the contact holder h contains a predetermined number of wire segments s, with an associated intermediate eject station 25 to eject those contact holders containing less than the required number of wire segments, and an ejection and collection station 27 for automatically and protectively collecting the finished brush contacts c.

Figure 2:
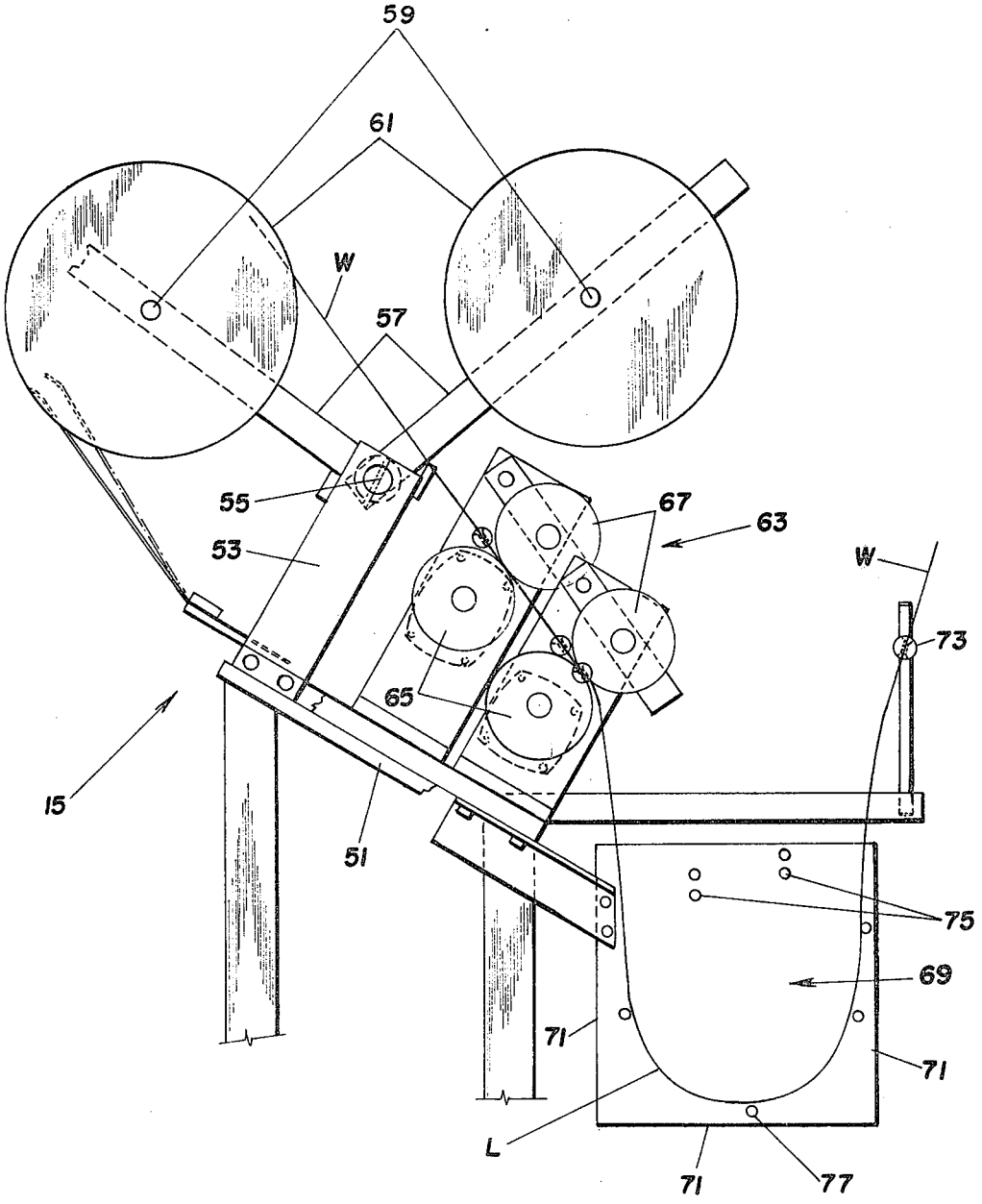
FIG. 2 is a side elevational view partly in cross-section of the wire feeding station, illustrating a wire spool in operational position and in replacement position.

Referring to the drawings now, in the sequence for manufacture of contacts c, reference is made to FIG. 2 where the wire feeding station is described in detail. Because of the very small diameter of the wire segments s that are generally used in electrical brush contacts, the wire dereeler must be capable of unreeling small diameter wires w from a plurality of independent wire spools while providing sufficient tension to prevent tangling of loose wire loops, must provide for quick and convenient changing of wire coil spools, must unreel the wires w from the spools without damaging the wires w, and also be capable of feeding a plurality of accurate wire lengths to the wire cutting station. The wire feeding station 15 comprises supports for a plurality of reels of wire w and unreeling means for each of the reels which permits independent operation thereof. As illustrated in FIG. 2, the feeding station 15 comprises a brace 51 with a pair of upwardly extending vertical supports 53. Between the vertical supports 53 is a cross-brace 55, the cross-brace having pivotally mounted thereon reel supports 57. The reel supports 57 are pivotable on the cross-brace 55 by manual movement and have lugs 59 which extend therefrom upon which reels 61 of wires w are situated, the reels being free wheeling on the lugs 59.

Adjacent the cross-brace 55 and supported by the brace 51 are driving means 63, one such driving means provided for each of the reels 61. As illustrated, each driving means 63 comprises a motor driven roller 65 and a complementary cushioning roller 67, the motor driven roller actuated by electrical means, not shown. Each reel 61 thus has its individual driving means, with the wire w from each free wheeling reel passing between the motor driven roller 65 and cushioning roller 67. By actuation and rotation of the motor driven roller, the wire, held in contact with the motor driven roller by the cushioning roller, is fed through the driving means 63 at a preselected rate.

Figure 3:
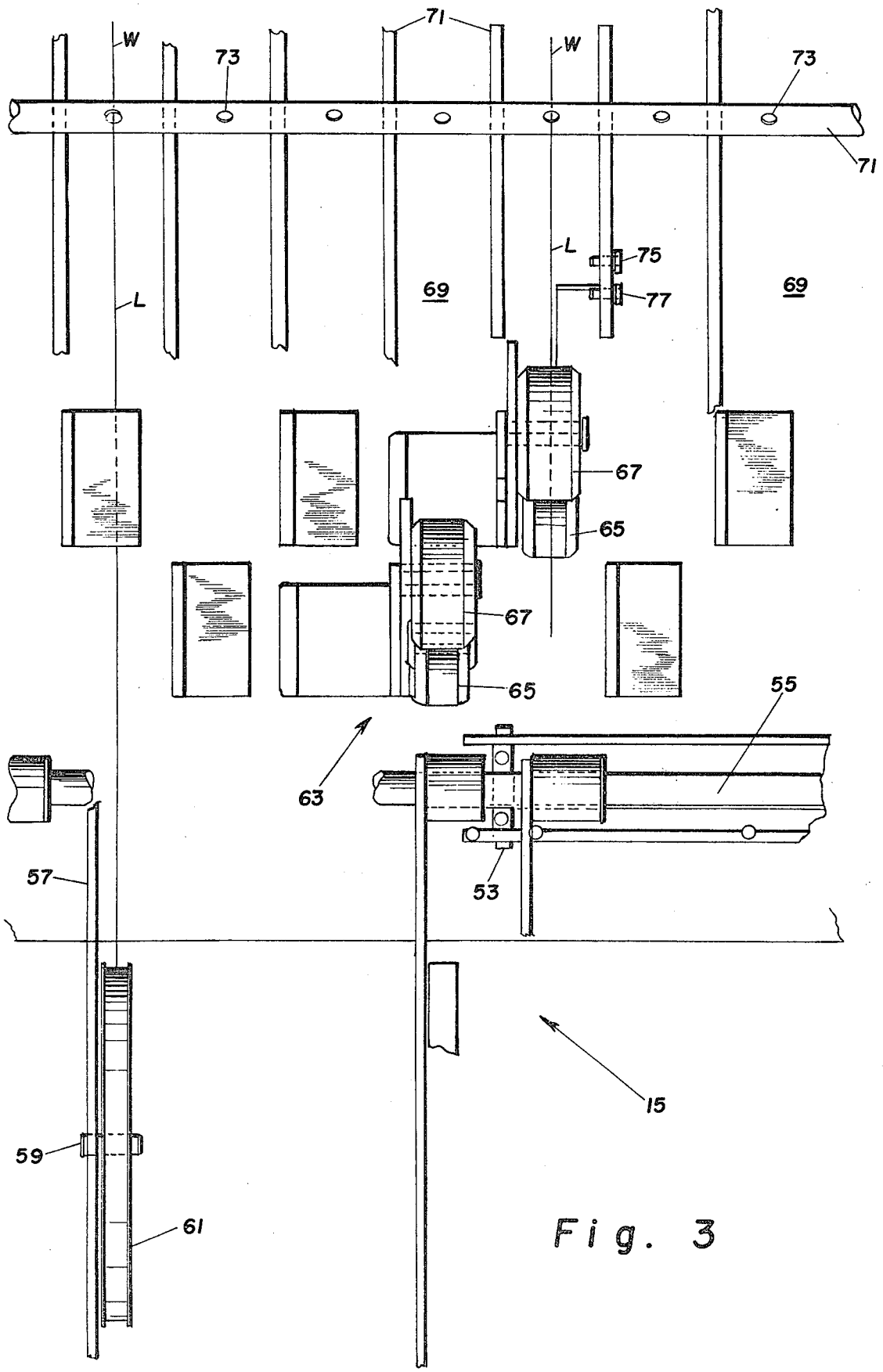
FIG. 3 is a cut-away sectional plan view of a portion of the wire feeding station showing the drive means for the wire and insulated cells through which the wires pass.

Considering FIGS. 1 to 3, because of the fragility of wires w of such small diameter, it is important that the rate of feeding of the wire w from each of the reels 61 be controlled so as to prevent too much tension on the exposed wire w, as well as prevent too much unwinding of wire w and possible entanglement thereof. In order to control the amount of wire w unreeling from each reel at any particular time, a system is provided to control the activation and deactivation of the driving means 63. As shown, a plurality of cells 69 are positioned between the driving means 63 and the wire cutting station 17. These cells 69, formed of a dielectric material such as spaced plexiglass sheets 71, insulate the wires w from each other during the unreeling and support conductive activating and deactivating means for the motor driven rollers 65. Within each cell 69 situate transverse to the direction of the unreeling of the wires are contacts which regulate the activation and deactivation of the power source for the motor driven rollers 65. Across the front of the cells 71 is a plexiglass wall, having an eyelet 73 for the wire w passing through each cell. Starting contacts 75 are positioned intermediate each pair of the sheets 71 adjacent the top of the sheets, while a stop contact 77 is positioned intermediate each pair of sheets 71 adjacent the lower region of the sheets. Wire w is initially unwound from the reels 61, placed between the motor driven roller 65 and cushioning roller 67, brought through the cells between the spaced sheets 71 and between the starting contact 75 and the stop contact 77, and finally through the eyelet 73 and thence to the cutting and segment feeding station 17. The motors for each of the motor driven wheels 65 are inactive at this time. Upon pulling of the wire w by the cutting and segment feeding station 17, the loop l of the wire in the cell will shorten to the point that the wire w contacts the starting contacts 75. Upon such contact the motor for the motor driven roller 65 is energized and further wire w is unreeled from the rolls thereof. If, during operation of the apparatus, the wire loop l becomes too long to assure the desired amount of tension on the wire w and prevent tangling, the wire w will contact stop contact 77 which will deenergize the motor. The unreeling of the wire w will thus be suspended until the wire loop l again shortens and contacts the starting contact 75.

The wires w are fed in parallel relationship to the cutting and segment feeding station 17 wherein a plurality of segments s are cut from the plurality of wires and the segments fed to a common collection point.

Figure 4:
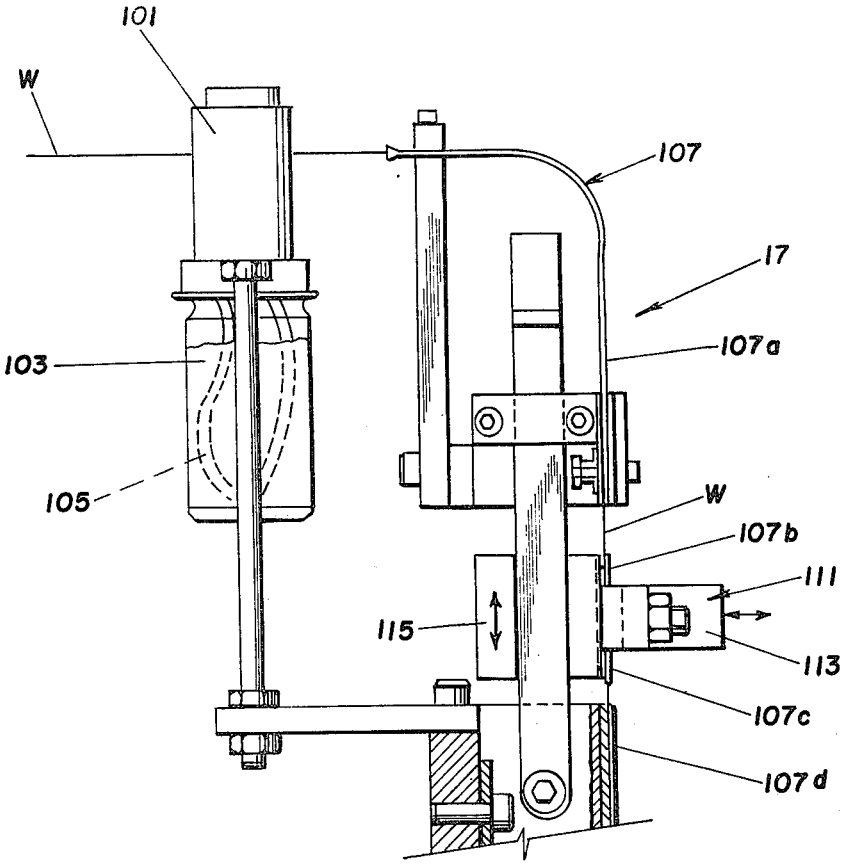
FIG. 4 is a side elevational view of the cleaning and feeding means for wire fed to the cutting mechanism.
Figure 5:
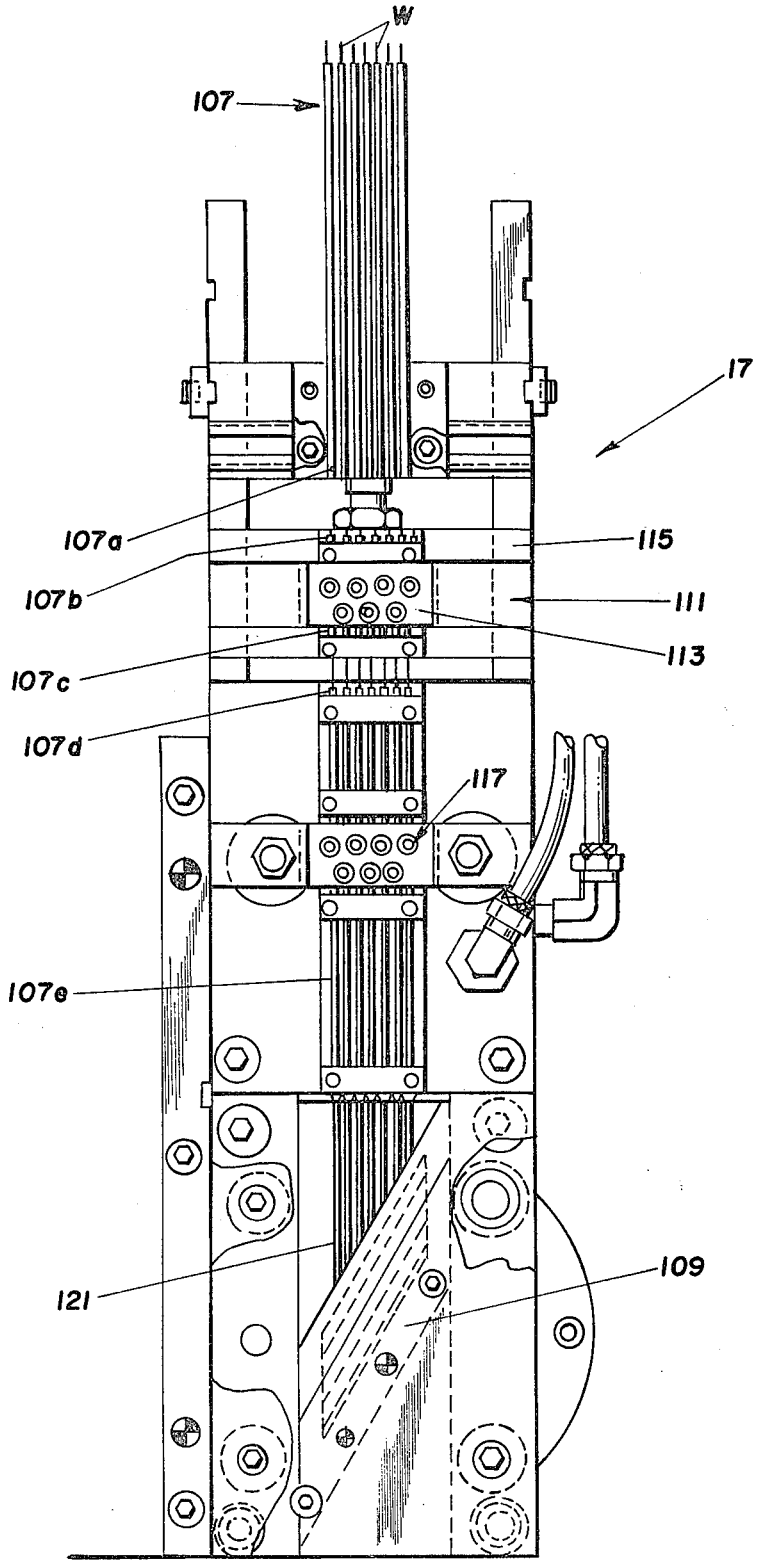
FIG. 5 is a schematic illustration, in elevation of the wire segment feeding and cutting mechanism.

The cutting and segment feeding station 17 provides for simultaneous shearing of segments s from the plurality of wires w and feeding of those segments to a common collection point for depositing of the segments into a brush contact holder h. The cutting and feeding station is preferably the type disclosed and claimed in application Ser. No. 153,305, now U.S. Pat. No. 4,309,928, entitled "Apparatus For Simultaneously Cutting Wire Segments From a Plurality of Wires", filed on even date herewith, in the names of Jan Mitrzyk, Rodney Gosso, Charles Fischer, Howard Silvernail and Charles Null, and assigned to the assignee of the present invention, the contents of said application incorporated by reference herein. As described in said copending application, and illustrated in FIGS. 4 and 5, the wires w are passed through felt cleaning pads 101, which are fed with a cleaning solution 103 by means of a wick system 105, the wires w then passing through a series of spaced parallel tubes 107, such as coaxial tubes 107*a*–107*e*, and into the cutting means 109. The wires pass from tube 107*a* to tube 107*b*, with exposed wire therebetween, the tube 107*b* being carried by a feed means 111. At feed means 111, the wires w are again exposed between tubes 107*b* and 107*c*, and a clamp means 113 clamps the wires w to a coacting reciprocable plate 115 intermediate tubes 107*b* and 107*c*. The reciprocable plate 115 and clamp means 113 are reciprocably mounted on supports and clamp the wires w and, by reciprocation, move the wires w in the direction of feeding to the cutting means 109. The wires then move through tubes 107*c* to tubes 107*d*. A spacing between tubes 107*d* and 107*e* enables clamping of the wires by clamp means 117, which clamp means 117 retains the wires motionless while the reciprocable feed means returns to its rest position, following reciprocation to its furthermost position of feeding. The wires are then fed to the cutting means 109 wherein segments s are simultaneously cut from the plurality of wires w.

Figure 6:
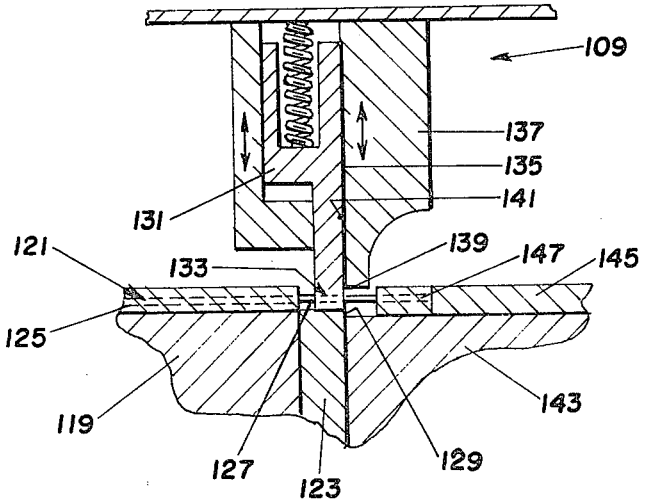
FIG. 6 is a cross-sectional view of the cutting means of the present apparatus.
Figure 7:
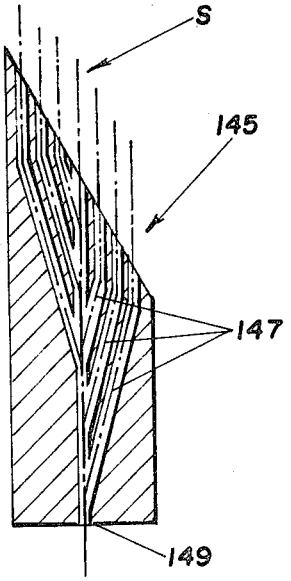
FIG. 7 is a plan view of the underside of the collection means for the cut wire segments.

Considering also FIGS. 6 and 7, the cutting means 109 includes a guide base 119 containing tubular guides 121, and a base member 123 adjacent thereto, each having coaxial grooves 125 and 127 therein, the base member 123 having a sliding surface 129 transverse to the axes of the grooves 127. A pressure pad 131 having grooves 133 and a sliding surface 135 is provided to clamp the wires w firmly to the base member 123 during the cutting operation, while a shear plate 137 having grooves 139 and a sliding surface 141 is arranged to reciprocate such that the sliding surface 141 thereof will slide along sliding surface 135 of the pressure pad 131 and the sliding surface 129 of the base member 123 to shear wire segments s from wires w extending from grooves 127 and 133. A segment collection base 143 and superimposed collection plate 145 are provided, such that the segments s will fall by gravity from the region of the shear plate 137 and be channeled through a plurality of grooves 147 to a common groove 149 and to a vibrating funnel 150 (FIG. 8) which feeds the segments to the holder h which is provided at the holder loading station 19.

As shown in FIG. 1, a plurality of holders h are initially positioned in a vibrating bowl 151, the holders h preferably being discharged from bowl 151 to a track 153, and the holders h introduced sequentially into cradles or means for cradling 155 and the cradles containing the holders h passed sequentially to the holder loading station 19 for introduction of the segments s to the holder h. The holders h comprise stems 157 and cup portions 159, the stem portions being held in cradle 155 with the cup portion 159 vertically positioned, the open end of the cup portion being exposed. A holder monitoring station 161 may be provided such that the dimensions of the holder cup portion 159 is checked for flaws by insertion of a pin 163 into the cup portions 159 of the holder h.

Figure 8:
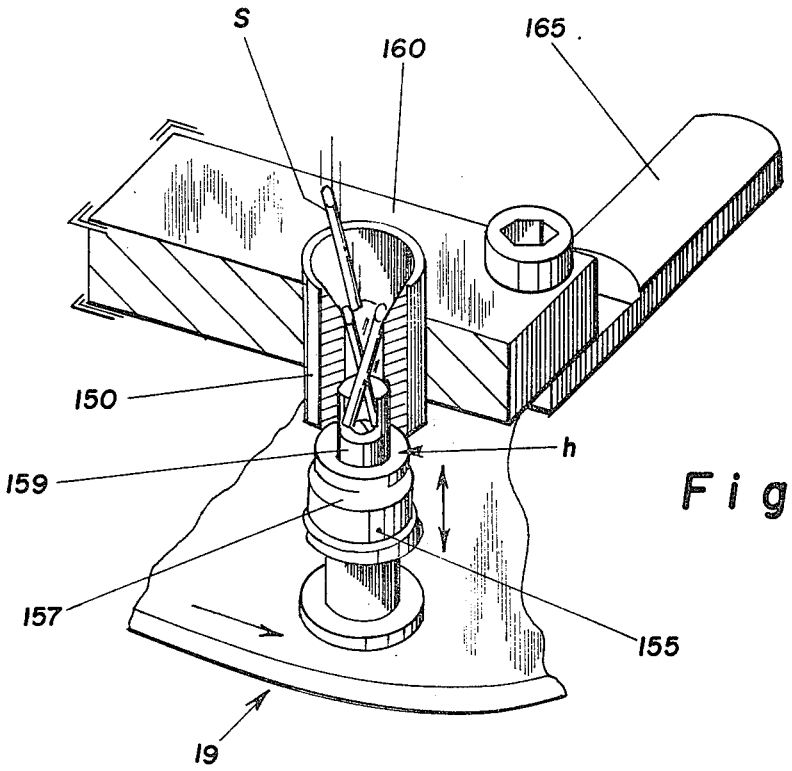
FIG. 8 is a schematic illustration of the holder loading station for loading cut wire segments in the cup portion of a brush contact holder.

Turning now to FIG. 8, at the holder loading station 19, a holder h is positioned below the segment cutting and feeding means 17, while segments s are fed to a holder h. The segments s are fed from common groove 149 to the vibrating funnel 150, the funnel 150 superimposed over the cup portion 159 of the holder and vibrated by means of a vibrating support 160, by vibration means generally illustrated as 165.

The holder h, containing segments s with acute angular ends thereof exposed is next passed to a crimping station 21. At the crimping station 21 means are provided for crimping the holder h to retain the plurality of wire segments s therein while preventing flaring of the exposed portions of the wire segments relative to each other. After the holder h has had the plurality of wire segments s positioned in the cup portion 159, with the segments s and their angular ends extending from the holder, the holder must next be crimped about the cup portion so as to retain the wire segments s therein. Individual wire segment retention must meet a minimum pull force while maintaining a minimum wire bundle diameter at the mating tips of the segments. Such retention by crimping of the cup portions of the holder must be effected without causing flaring of the exposed wire segment ends.

The holder h, in its cradle 155, is passed to crimping station 21. At crimping station 21 the cup portion 159 of the holder is crimped at two spaced positions about its periphery to retain the segments s in the holder. As illustrated in FIGS. 9-15, the crimping apparatus 21 comprises four diametrically spaced fingers 201 which are positioned within slots 203 in a guide plate 205. Each finger 201 has an arcuate outer end 207, and an arcuate inner end 209, the arcuate inner end 209 having a first lower crimp surface 210 and a second upper recessed crimp surface 211 spaced from the first crimp surface. The outer end 207 of the finger 201 is radiused, as at 213, and each finger has a depending pin 215. A cam ring 217 surrounds the guide plate 205 and the fingers 201 contained within the slots 203 of the guide plate, with the beveled ends 213 of the fingers 201 in contact with cam surface 219. Cam surface 219 is an indented surface and the cam surface is first tangential and then curved, as illustrated at 223 and 225 respectively. By rotational movement of the cam ring 217 through movement of its attached handle 227, the fingers 201 in contact therewith will be moved towards each other such that the crimp surfaces 209 and 211 contact the cup portion of the holder h and crimp the same to retain the segments s therein. To retract the fingers 201 from crimping position, the depending pins 215 are engaged to move the fingers to a retracted position to allow removal of the crimped contact. The reverse rotation of the cam arm rotates the guide plate with the cam ring and engages the depending pins and retracts the fingers.

Figure 9:
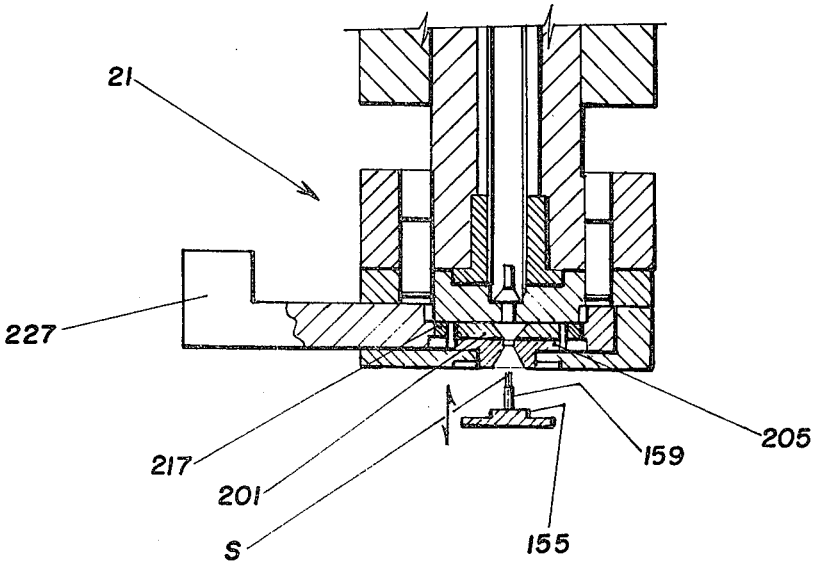
FIG. 9 is a cross-sectional view of the crimping means for crimping the cup portion of a holder to retain the wire segments therein without flaring of the exposed ends.
Figure 10:
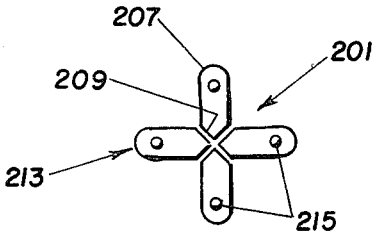
FIG. 10 is a schematic view of the crimping fingers provided in the crimping means shown in FIG. 9.
Figure 11:
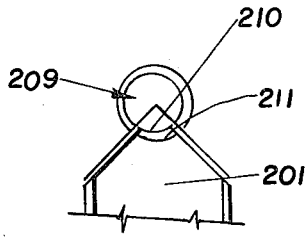
FIG. 11 is a plan view of the inward arcuate end of a crimping finger shown in FIG. 10.
Figure 12:
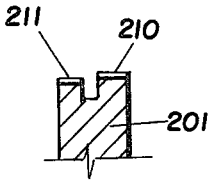
FIG. 12 is a cross-section of a side view of the inward arcuate end of the finger shown in FIG. 11.
Figure 13:
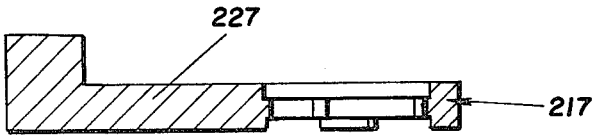
FIG. 13 is a cross-section of the cam ring provided in the crimping means.
Figure 14:
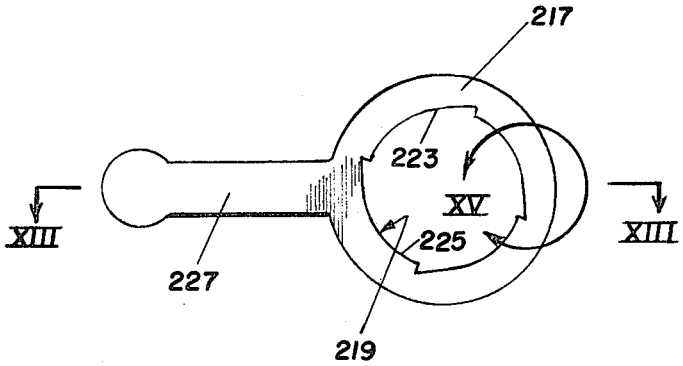
FIG. 14 is a plan view of the cam ring shown in FIG. 13.
Figure 15:
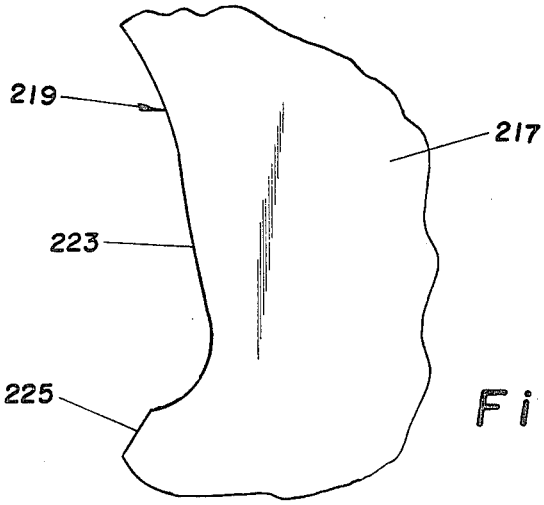
FIG. 15 is an enlarged view of the portion of the cam ring identified as XV in FIG. 14 showing the cam surface.

In FIG. 9, the cradle is indicated in position about to be raised into the crimping device, such that a holder h when contained therein rests within the cradle and the cup portion is exposed. Upon raising, the cup portion would be situated between the fingers 201, surrounded by cam ring 217, and actuation of the cam handle 227 moves the fingers 201 towards each other to crimp the cup portion of the holder.

After crimping is effected, the contact is is lowered and indexed from the crimp station.

Figure 16:
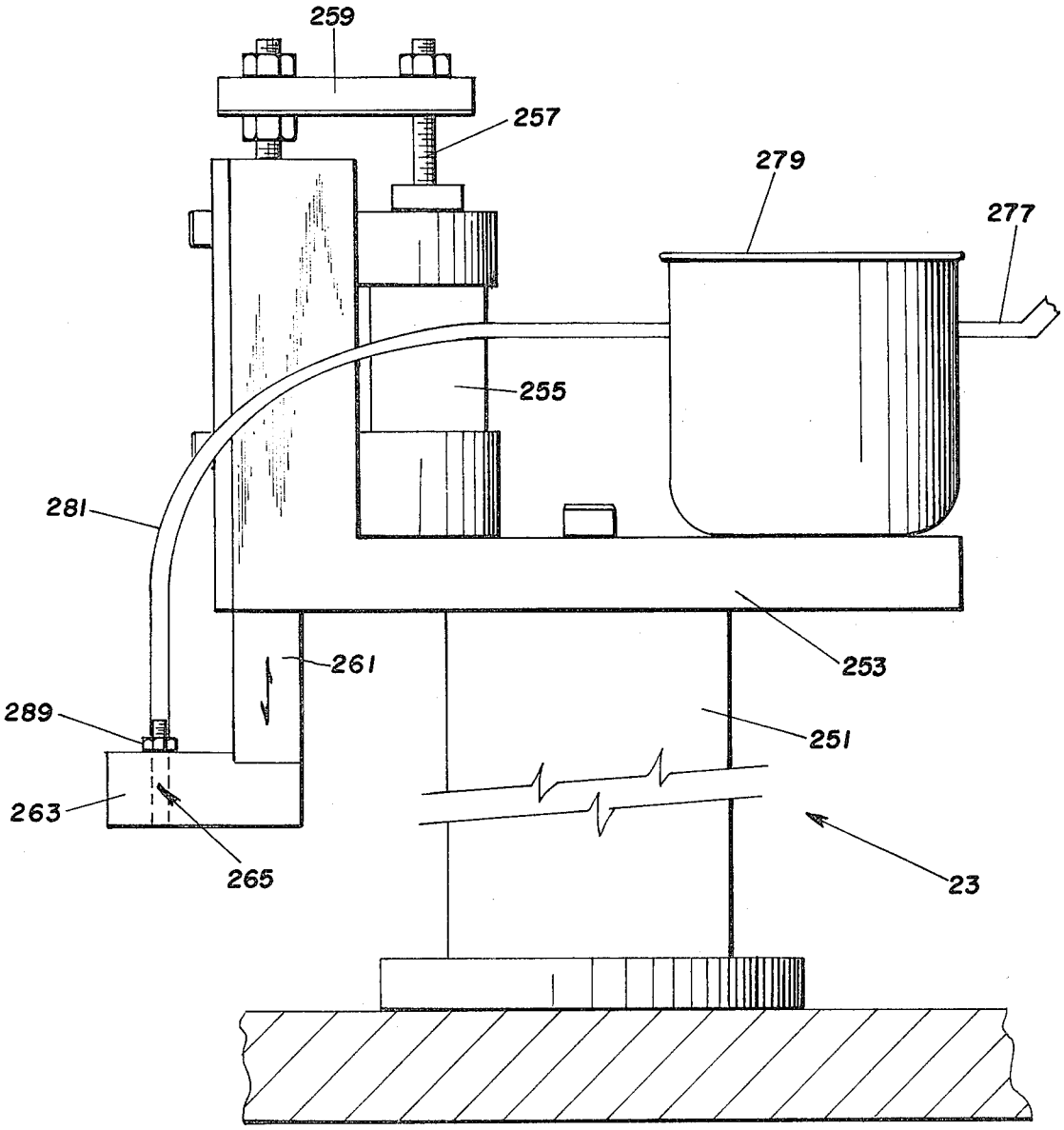
FIG. 16 is a schematic view of the means for checking wire contacts, following crimping, to determine whether the contact contains the required number of wires.

After the crimping operation, the brush contacts c are suitable for use as male contacts, upon removal of the contacts c from the cradle 155. In order to assure the quality of the contact c, i.e. that the contact c contains a predetermined number of wire segments s, a checking station 23 is provided. The checking station 23 uses a measurement of air flow through an orifice, within which the wire segments s of a contact are situated, to determine whether or not the correct number of wire segments s are present in the contact c. As illustrated in FIG. 16, a support 251 has thereon a bracket 253, the bracket 253 carrying a cylinder 255 and rod 257 that is connected by arm 259 to a slide 261, such that activation of the cylinder 255 will reciprocate the slide 261 vertically. Attached to the lower portion of the slide 261 is a sensor head 263, the sensor head comprising a metallic block having a specifically dimensioned orifice 265 vertically therethrough. The bracket 253 also supports an air restrictor such as that sold by Air Logic, and a switch which is in normally closed position.

Figure 17:
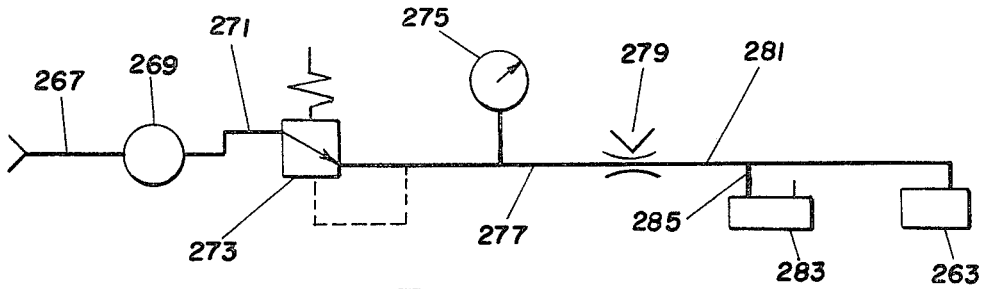
FIG. 17 is a schematic view of the operational sequence of the checking means of FIG. 16.

In operation of the checking station, as illustrated by the schematic drawing in FIG. 17, a supply of air from a source (not shown) generally at 60# psi, is passed through line 267 to filter 269 and then through line 271 to regulator 273 to provide a controlled flow of air at 3 pounds gauge. The air pressure is monitored by a gauge 275 in line 277. The monitored air is passed through the air restrictor 279 and then through line 281 to the sensor head 263. The switch 283 is in normally closed position, in contact with a pressure line 285. When a contact c, having wire segments s extending therefrom, is moved by cradle 155 to a position directly below the orifice 265 of the sensor head 263, the slide 261, carrying the sensor head, is lowered by means of the connection to cylinder 255. Air at controlled pressure is passed through flexible line 281 to a connection 289 situated over the orifice 265. When the contact c contains the required number of wire segments s, the air flow through the orifice will be within a predetermined range and the normally closed switch 283 will signal the same. In the event, however, that fewer than the required number of wire segments s are present in the contact c, the flow through orifice 265 surrounding the wire segments s will be greater than the predetermined value and switch 283 will open to signal, by a light or other means (not shown), that the contact is defective, with the signal relayed to a later station for operation of an ejection means to remove the contact prior to the contact reaching the product collection point.

Figure 18:
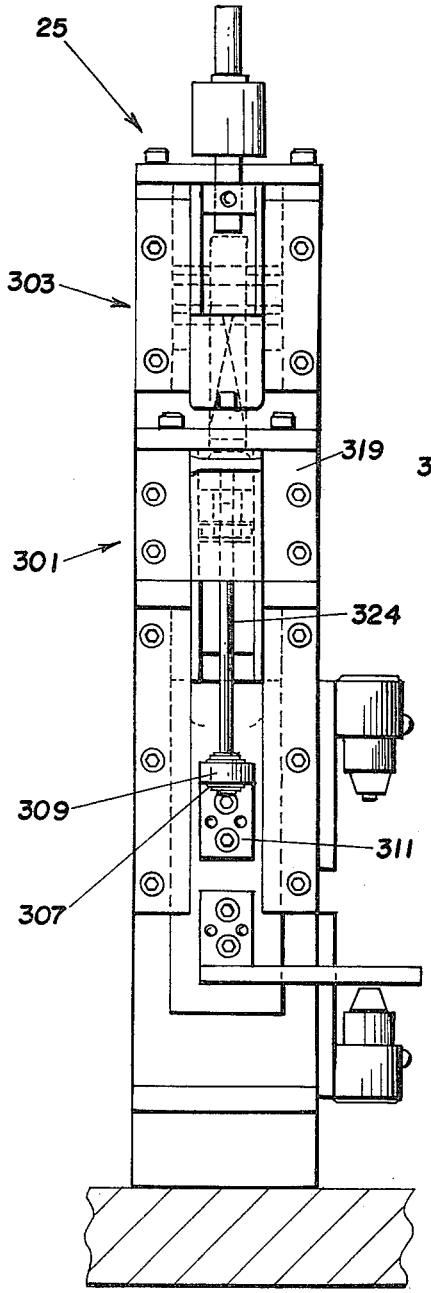
FIG. 18 is a front elevational view of the eject mechanism for use in the present apparatus to eject brush contacts from the cradles therefore.
Figure 19:
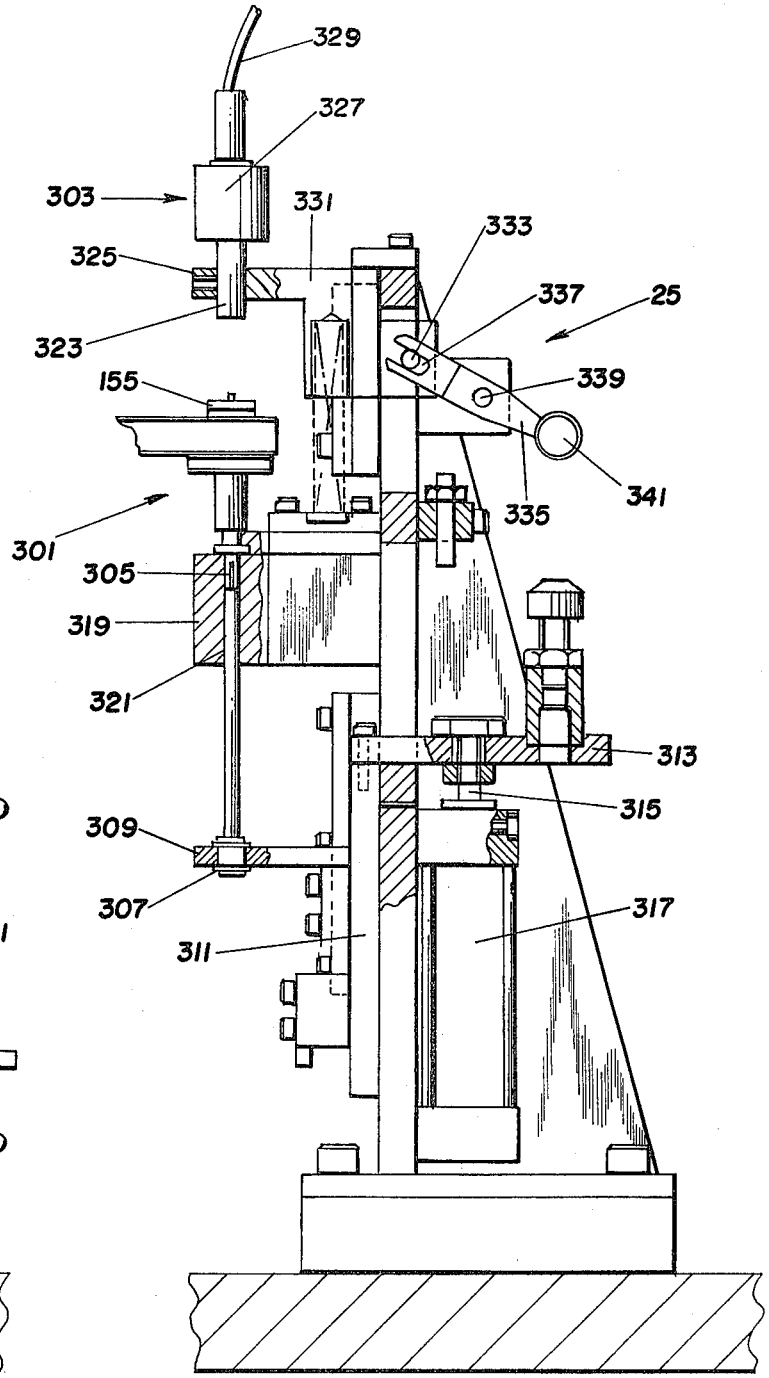
FIG. 19 is a side elevational view with cut-away portions of the eject means of FIG. 18.
Figure 20:
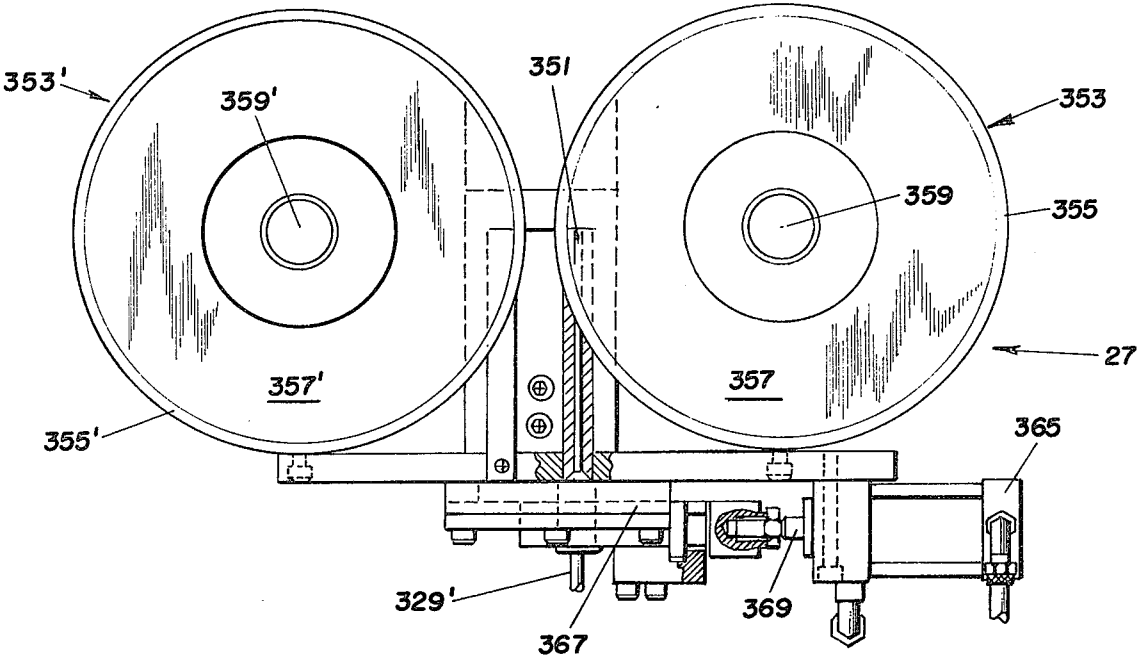
FIG. 20 is a top plan view, with cut-away portions, of the collection means for finished brush controls.
Figure 21:
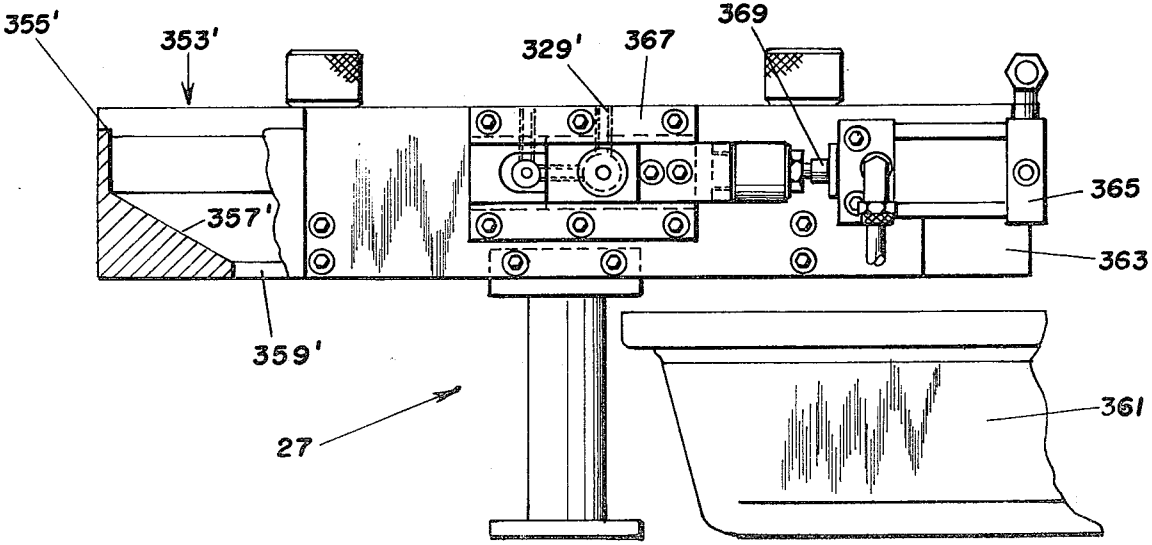
FIG. 21 is a side elevational view, with cut-a-way portions of the collection means of FIG. 20.

The assembled, tested contact is next moved by its cradle to the intermediate ejection station 25 where brush contacts which contain less than the required number of wire segments are removed. The intermediate eject station 25, illustrated in FIGS. 18 and 19, comprise means 301 for ejecting the contact from its cradle and means 303 for collecting and transferring the ejected contact to a collection point. As illustrated, the cradle 155 containing a contact that has fewer than the required number of wire segments is moved between the ejection means 301 and collection means 303. Ejection means 301 comprises an ejection pin 305 attached by means of snap ring 307 to a block 309. Block 309 is, in turn, attached by means of guide plate 311 to a slide block 313, and the slide block 313 attached, in turn, to rod 315 of air cylinder 317. A guide block 319 is positioned below the cradle, having a bore 321 therein through which the ejection pin slides and is guided.

In the collection means 303, a tube 323, carried on a slide 325 cooperates with a venturi 327, the venturi connected by means of flexible tubing 329 to a source of vacuum (not shown). The slide 325 is affixed to brace 331, which brace has a dowel pin 333. A lever arm 335, having a slot 337 at one end, and being pivotable about pivot 339, has at its other end a roll bar 341, which roll bar is contacted by a surface (not shown) to lower the tube 323 to a position immediately above the cradle when the cradle carrying a holder is positioned between the ejector means 301 and collecting means 303.

As described previously, when a holder is detected at the checking station 23 that contains less than the requisite number of wire segments s, a signal is sent to the intermediate ejection station 25, such that when such a holder reaches the ejection station, the ejector pin 305 is contacted through connection with cylinder 317, and the holder is ejected from the cradle and, with the tube 323 positioned immediately above the cradle, the vacuum will cause the defective holder to pass through tube 323, venturi 327 and flexible tubing 329 to a defective contact collection point.

Contacts c which contain the correct number of wire segments s pass by the intermediate ejection station 25 and are moved to the ejection and collection station 27. The ejection and collection station 27 comprises means for ejecting the contacts c from cradles 155 and for collecting the ejected contacts, which ejection means and collection means are the same as the intermediate ejection station 25. The collection of the contacts, however, due to the exposure of exposed arcuate ends of wire segments s contained in the contact, must be done in such a manner as to protect the exposed ends from damage. The contacts c are then passed from the flexible tubing 329', such as tubing 329 of the intermediate ejection station, to a deceleration chamber prior to dropping into a container for the finished contacts. The contacts c are carried through tubing 329' to a connected tubular feed 351, which tubular feed 351 discharges the contacts c into deceleration bowl 353. Deceleration bowl 353 has an outer circular wall 355 and a frustoconical bottom wall 357, the bottom wall 357 having an opening 359 therein from which the contacts will fall by gravity into a collection container 361. A cover 363 is provided to close the bowl. As contacts c are discharged from the tubular feed 351, the contacts will travel about the inner periphery of the bowl 353, formed by wall 355 and the speed of the contact travel lowered before the contacts fall along the frustoconical bottom wall 357 and out of opening 359 into the container 361. A second deceleration bowl 353' is also provided having outer circular wall 355', frustoconical bottom wall 357' and opening 359' therein for collection of contacts. Means 363 are provided, including an air cylinder 365, activated by an air supply (not shown), and a slide plate 367 connected through piston 369 to the air cylinder 365, which shifts the tubular feed 351 from either collection bowl 353 to bowl 353'.

Figure 22:
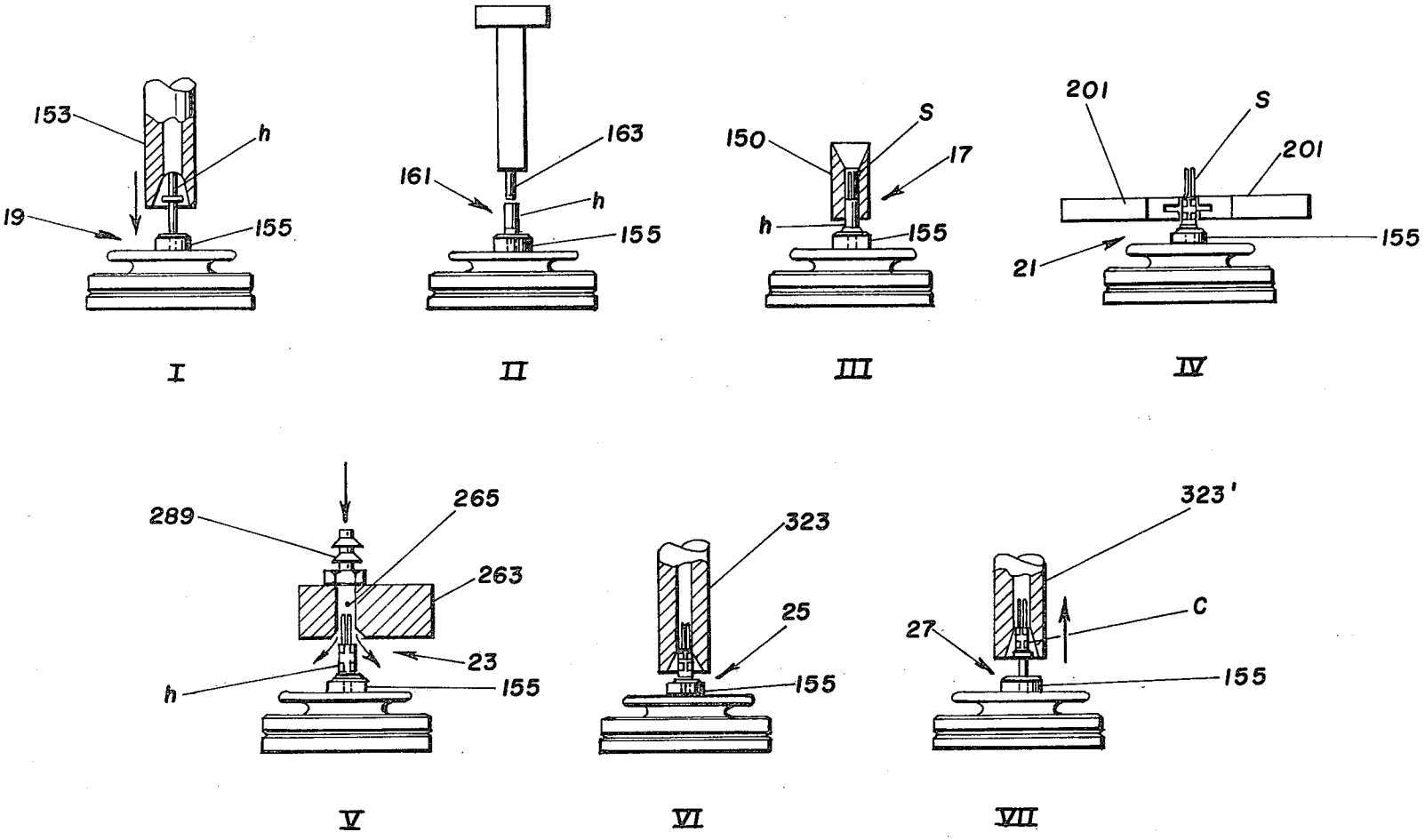
FIG. 22 is a schematic illustration of the various stations of the apparatus of the present invention.

The movement of a cradle 155 and operational sequence of the apparatus are illustrated in FIG. 22 for formation of contacts c. As illustrated at I, a contact holder h is charged to a cradle 155, and the cradle is then moved to II, where the dimension of the holder is monitored. At III, a plurality of wire segments s are charged to the holder h, through funnel 150. The holder h now containing the wire segments s, is next passed to the crimping station 21, shown at IV, where the fingers 201 crimp the cup portion of the holder h to retain the wire segments s therein without causing flaring. The crimped holder next passes, as shown at V, to checking station 23 where a determination is made as to whether or not the holder h contains the requisite number of wire segments s, and, if not, the defective holder, as shown at VI is removed from the cradle at the intermediate ejection station 25. Brush contacts that have the requisite number of wires will then pass to the ejection and collection station 27, as shown at VII, for collection.

As is seen from the above, the present apparatus is usable to continuously produce brush contacts c from a supply of holders and rolls of conductive wire.

What is claimed is:

1. An apparatus for continuous production of electrical brush contacts having a plurality of wire segments, with acute angular exposed ends, secured in holder, comprising:

(a) means for feeding a plurality of wires from a plurality of rolls of wire independently of each other;

(b) means for simultaneously cutting a section from each of said plurality of wires to form a plurality of wire segments having acute angular ends and feeding said wires to a common collection point;

(c) means for cradling a holder for said plurality of wire segments, the holder being releasably positioned within the cradling means for receipt of said wire segments from the common collection point;

(d) means for loading said plurality of wire segments in said holder, with a portion of said wire segments having acute angular ends exposed;

(e) means for crimping said holder to retain said plurality of wire segments therein while preventing flaring of said exposed portions of the wire segments relative to each other, to form an electrical brush contact;

(f) means for ejecting brush contacts from said cradling means comprising an ejection pin and superimposed collection means for said contacts; and (g) means for checking said contacts to determine whether a correct number of wire segments are present in said contacts prior to said contacts reaching said ejection means.

2. The apparatus defined in claim 1 wherein said means for checking said contacts comprises a block having an orifice therethrough, an inlet end and outlet end for said orifice, means for inserting the holder containing the exposed wire segments into the outlet end of said orifice, means for passing a set flow of air through the inlet end of said orifice, and means for measuring the restriction to flow of air through the orifice.

3. The apparatus as defined in claim 2 including an intermediate means for ejecting brush contacts from said cradles, comprising an ejection pin and superimposed collection means for said contacts, and means for actuating said intermediate ejection means when a contact checked at said checking station which contains less than the correct number of wire segments reaches said intermediate ejection means.

4. An apparatus for continuous production of electrical brush contacts having a plurality of wire segments, with acute angular exposed ends, secured in a holder, comprising:

(a) means for feeding a plurality of wires from a plurality of rolls of wire independently of each other comprising support means for a plurality of rolls of wires and independently operated pairs of a motor driven roller and a cushioning roller for each of said wires, and means for activating each of said motor driven rollers;

(b) means for simultaneously cutting a section from each of said plurality of wires to form a plurality of wire segments having acute angular ends and feeding said wires to a common collection point;

(c) means for cradling a holder for said plurality of wire segments, the holder being releasably positioned within the cradling means for receipt of said wire segments from the common collection point:

(d) means for loading said plurality of wire segments in said holder, with a portion of said wire segments having acute angular ends exposed; and (e) means for crimping said holder to retain said plurality of wire segments therein while preventing flaring of said exposed portions of the wire segments relative to each other, to form an electrical brush contact.

5. The apparatus as defined in claim 4 wherein said means for actuating each of said motor driven rollers comprises an electrical contact energized by contact of said wire therewith.

6. The apparatus as defined in claim 5 wherein means are provided to deactuate each of said motor driven rollers comprising an electrical contact energized by contact of said wire therewith.

7. The apparatus as defined in claim 5 wherein a loop of said wire is passed between said means for actuating said motor driven rollers and said means for deactuating said motor driven roller and wherein the former is positioned above the latter.

8. The apparatus as defined in claim 7 wherein sheets of insulating material are provided between adjacent wire loops, and said contacts are supported by said sheets.

9. The apparatus as defined in claim 8 wherein insulating bars are situated between said sheets, said bars having eyelets through which said wires pass after passage between said contacts.

10. An apparatus for continuous production of electrical brush contacts having a plurality of wire segments, with acute angular exposed ends, secured in a holder, comprising:

(a) means for feeding a plurality of wires from a plurality of rolls of wire independently of each other, said feeding means having support means for said plurality of rolls, independently operated pairs of a motor driven roller and a cushioning roller for each of said wires, an electrical contact energized by contact of said wires for actuating each of said motor driven rollers, and a second electric contact for contact by said wires for deactuating each of said motor driven rollers, with a loop of each of said wires between said actuation means and deactuation means;

(b) means for simultaneously cutting a section from each of said plurality of wires to form a plurality of wire segments having acute angular ends and feeding said segments to a common collection point;

(c) means for cradling a holder, releasably positioned, in a vertical position, within the cradling means therefor, for receipt of said wire segments from the common collection point;

(d) means for loading said plurality of wire segments in said holder, with a portion of said wire segments having acute angular ends exposed; and (e) means for crimping said holder to retain said plurality of wire segments therein while preventing flaring of said exposed portions of wire segments relative to each other, having spaced fingers having arcuate inner ends, said fingers having two crimping surfaces, a lower crimp surface and a spaced recessed upper crimp surface, means for positioning the holder between said spaced fingers, and means for reciprocating said fingers toward each other to contact the holder and form a crimp therein, to form said electrical brush contacts.

11. The apparatus defined in claim 10 including means for ejecting brush contacts from said cradles comprising an ejection pin and superimposed collection means for said contacts.

12. The apparatus as defined in claim 11 including means for checking said contacts to determine whether a correct number of wire segments are present therein prior to said contacts reaching said ejection means comprising a block having an orifice therethrough, an inlet end and outlet end for said orifices, means for inserting the holder containing the exposed wire segments into the outlet end of said orifice, means for passing a set flow of air through the inlet end of said orifice, and means for measuring the restriction to flow of air through the orifice, and including an intermediate means for ejecting brush contacts from said means for cradling, comprising an ejection pin and superimposed collection means for said contacts, and means for actuating said intermediate ejection means when a contact checked at said checking station which contains less than the correct number of wire segments reaches said intermediate ejection means.

* * * * *